US010201262B1

(12) United States Patent
Serfas et al.

(10) Patent No.: US 10,201,262 B1
(45) Date of Patent: Feb. 12, 2019

(54) LOBBY DUSTPAN

(71) Applicant: R.S. Quality Products Inc, Allentown, PA (US)

(72) Inventors: Adam H. Serfas, Allentown, PA (US); Robert L. Serfas, Allentown, PA (US); David D. McClanahan, Harleysville, PA (US)

(73) Assignee: R.S. Quality Products Inc, Allentown, PA (US)

( * ) Notice: Subject to any disclaimer, the term of this patent is extended or adjusted under 35 U.S.C. 154(b) by 18 days.

(21) Appl. No.: 15/704,307

(22) Filed: Sep. 14, 2017

(51) Int. Cl.
*A47L 13/52* (2006.01)
*A47L 13/51* (2006.01)

(52) U.S. Cl.
CPC ..... *A47L 13/52* (2013.01); *A47L 13/51* (2013.01)

(58) Field of Classification Search
CPC ..... A47L 13/52; B08B 9/093
USPC ..... 15/257.1–257.9
See application file for complete search history.

(56) References Cited

U.S. PATENT DOCUMENTS 5,343,589 A * 9/1994 Davenport ..... A47L 13/52 15/257.4
5,367,737 A 11/1994 Vosbikian et al.
5,379,481 A 1/1995 DeMars
6,023,812 A * 2/2000 Morad ..... A47L 13/52 15/257.1
6,233,781 B1 5/2001 Savage
6,282,745 B1 * 9/2001 Alt ..... A47L 13/52 15/257.4
6,643,891 B1 11/2003 Jerstroem et al.
6,902,060 B2 6/2005 Michelson et al.
7,404,229 B2 7/2008 Monahan et al.
8,544,906 B2 * 10/2013 Northrop ..... E01H 1/1206 294/1.4
8,904,589 B2 * 12/2014 Santarsiero ..... A47L 13/11 15/105
9,027,197 B1 5/2015 Gao
9,913,566 B1 * 3/2018 McCormick ..... A47L 13/52
2003/0167588 A1 * 9/2003 Perelli ..... A47L 13/52 15/257.7
2005/0071943 A1 * 4/2005 Liu ..... A47L 13/52 15/257.2
2007/0089259 A1 4/2007 Jones
2007/0163069 A1 7/2007 Sampaio
(Continued)

*Primary Examiner* — Michael Jennings
(74) *Attorney, Agent, or Firm* — Invention To Patent Services; Alex Hobson

(57) ABSTRACT

A lobby dustpan is self-standing, self-closing and comprises a lid-handle coupling feature for receiving a broom head for retaining the broom head in the bucket of the lobby dustpan. The lid of the lobby dustpan substantially covers the opening of the bucket when in a closed position. A lobby dustpan is self-standing, wherein the center of gravity is between the outer contact points of the base. In addition, when the lobby dustpan is standing in an upright position on a horizontal surface, the center of gravity of the handle keeps the lid in a closed position. Furthermore, the center of gravity of the bucket is offset from the pivot assembly which causes the bucket to close when the lobby dustpan is lifted up from an open position. The specific geometry of the lobby dustpan enables a combination of features that heretofore are not available with existing lobby dustpans.

20 Claims, 13 Drawing Sheets

(56) References Cited

U.S. PATENT DOCUMENTS

| | | | | |
|---|---|---|---|---|
| 2008/0092321 | A1* | 4/2008 | Lin | A47L 13/52<br>15/257.7 |
| 2009/0059571 | A1* | 3/2009 | Quattrini | A47L 9/30<br>362/154 |
| 2011/0302735 | A1* | 12/2011 | Santarsiero | A47L 13/11<br>15/117 |

* cited by examiner

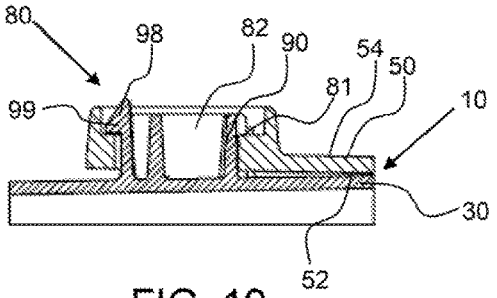
FIG. 19
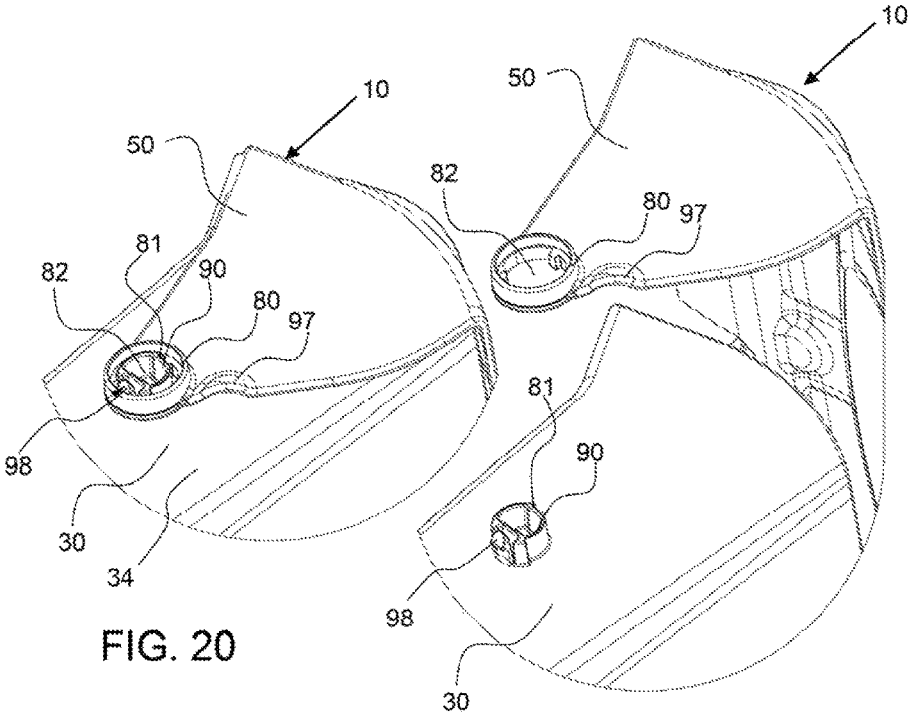
FIG. 20
FIG. 21

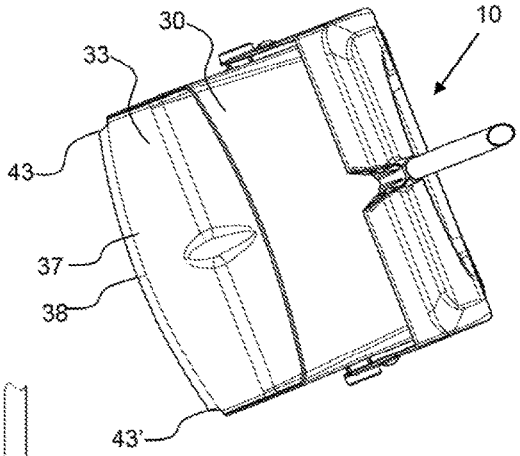
FIG. 25
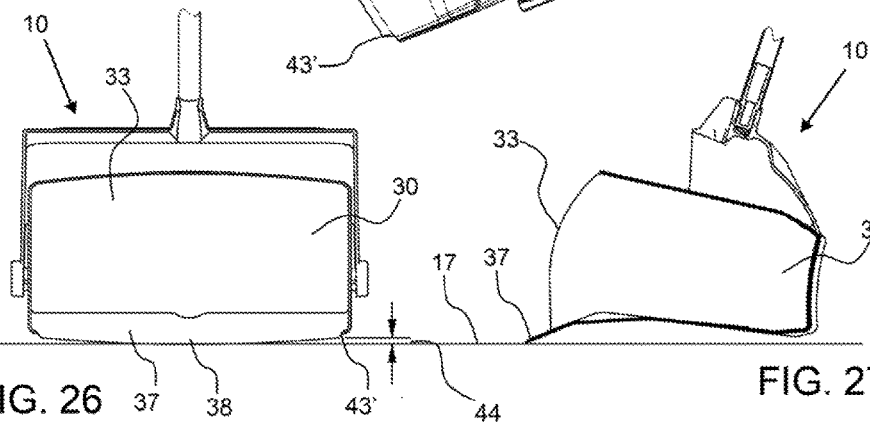
FIG. 26
FIG. 27
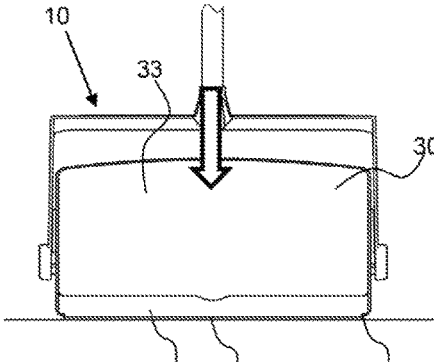
FIG. 28
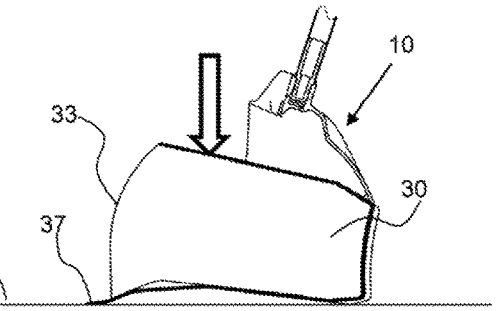
FIG. 29

LOBBY DUSTPAN

BACKGROUND OF THE INVENTION

Field of the Invention

The invention relates to lobby dustpans that has a pivoting assembly incorporating a position locking feature.

Background

Lobby dustpans are common tools and enable a user to sweep up debris without bending over to place and hold a dustpan. Many lobby dustpans pivot to configure the opening of the bucket along the floor to receive debris therein. The top of many lobby dustpans are open and debris collected within the bucket can blow or spill out. In addition, a broom carried along with the lobby dustpan can shed debris during transport from one location to another. Lobby dustpans may be stored on a peg or hook through an aperture in the handle or in some cases they are self-standing on their base.

SUMMARY OF THE INVENTION

The invention is directed to a lobby dustpan that is self-standing, self-closing and comprises a lid-handle coupling feature for receiving a broom head. An exemplary lobby dustpan has a lid that substantially covers the opening of the bucket when in a closed position. During transport, the broom head may be stored within the bucket of the lobby dustpan and the handle of the broom may be coupled with the lid-handle coupling feature. The handle of the broom and the handle of the lobby dustpan may extend parallel with each other when the broom is stored in the lobby dustpan. An exemplary lobby dustpan is self-standing, wherein the center of gravity is between the outer contact points of the base. In addition, when the lobby dustpan is standing in an upright position on a horizontal surface, the center of gravity of the handle keeps the lid in a closed position. Furthermore, the center of gravity of the bucket is offset from the pivot assembly which causes the bucket to close when the lobby dustpan is lifted up from an open position. The specific geometry of the exemplary lobby dustpan enables a combination of features that heretofore are not available with existing lobby dustpans.

An exemplary lobby dustpan comprises a pivot assembly that detachably attaches the lid to the bucket. An exemplary pivot assembly is configured on either side of the lobby dustpan and comprises a bucket hub that extends into a lid aperture. The lid rotates about the bucket hub and a position locking feature enables the bucket to be locked in an open position. The position locking feature comprises a detent and a detent-coupler, such as a protrusion that is retained by the detent. In an exemplary embodiment, the detent is configured in the lid aperture, such as along the inner perimeter of the lid aperture and the detent-coupler extends from the bucket hub. However, the detent could be configured in the bucket hub and the detent-coupler could be configured in the lid aperture. A pivot assembly may also comprise a stop to prevent over rotation of the bucket with respect to the lid. A stop may comprise a stop-extension extending from the bucket hub and a stop, or protrusion from the lid aperture, for example. The stop is configured to interface with the stop-extension when the lid is rotated with respect to the bucket to a locked position. A pivot assembly may comprise an attachment tab that extends from the bucket and into the lid aperture; wherein the lid and bucket are detachably attachable. An exemplary attachment tab may comprise a locking head that engages with the lid to lock the lid to the bucket when the lid and bucket are attached. A user may manipulate the locking head of the attachment tab to release the attachment tab and detach the bucket from the lid. An access recess may be configured along the lid to facilitate detachment of the bucket from the lid.

An exemplary lobby dustpan comprises a bucket with a center of gravity between the bucket hub, or pivot assembly and the base of the bucket when in an open position. This position of the center of gravity will cause the bucket to automatically close when the handle is lifted up vertically to lift the lobby dustpan from an open position with a sweep-ramp resting on the floor. The bucket will swing back closed as the lobby dustpan is picked up after collecting debris therein. The debris will be stored and protected in the bucket during transport as the lid substantially covers the opening of the bucket when in a closed position.

An exemplary lobby dustpan comprises a handle with a center of gravity that is forward from the pivot assembly by a handle offset distance. The handle has a length axis that extends forward from the lid-handle coupling feature, at a handle offset angle to vertical when the lobby dustpan is standing upright on a horizontal surface. An exemplary handle offset angle may be at least about 10 degrees, at least about 15 degrees, at least about 25 degrees and any angle between and including the angles provided. This configuration of the handle keeps the lid closed when the lobby dustpan is resting on the base in an upright and closed position. This configuration of the handle facilitates opening of the bucket wherein when the handle is brought straight down vertically, so that the back end of the bucket contacts the horizontal surface or floor first which kicks open the bucket and whereupon further force downward on the handle completely opens the bucket. The base plane of the bucket will have a bucket offset angle with the floor when the handle is brought down vertically. This base offset angle 47 may be about 5 degrees or more, about 10 degrees or more, about 20 degrees or more and any range between and including the angles provided.

An exemplary lobby dustpan comprises a base with recesses producing four base contacts that contact the horizontal surface, or floor, when the lobby dustpan is standing upright on said horizontal surface. Having the contact points of the base at the outer perimeter enables the lobby dustpan to stand upright in a more stable fashion.

An exemplary lobby dustpan comprises a broom-handle coupling feature comprising a pair of extensions that extend from a receiving portion for retaining a broom handle to the lid and a broom head within the bucket. The receiving portions may be tapered toward the receiving portion to guide the handle into the receiving portion. The receiving portion may be a circular shaped recess in the lid that is sized to receive the handle rod and retain it therein. The extensions may flex outward slightly to allow the broom handle to be inserted into the receiving portion and then snap back to an original position to retain the broom handle therein. A receiving portion may extend more than 180 degrees to allow the extension to snap around and retain the broom handle and may extend about 200 degrees, or about 220 degrees, or about 240 degrees, or about 270 degrees and any range between 180 degrees and the other amounts provided.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

FIG. 19 shows a cross sectional view of an exemplary pivoting assembly.

FIG. 20 shows a perspective view of an exemplary pivoting assembly having a position locking feature.

FIG. 21 shows a perspective view of the lid detached from the bucket portion of the lobby dustpan.

FIG. 25 shows a top view of an exemplary lobby dustpan in an open position with an exemplary crowned sweep-ramp.

FIG. 26 shows a front view of an exemplary lobby dustpan in an open position with an exemplary crowned sweep-ramp contacting the floor, or horizontal surface.

FIG. 27 shows a cross-sectional view of an exemplary lobby dustpan in an open position with an exemplary crowned sweep-ramp contacting the floor, or horizontal surface.

FIG. 28 shows a front view of an exemplary lobby dustpan in an open position and pressed down with an exemplary crowned sweep-ramp uniformly contacting the floor, or horizontal surface.

FIG. 29 shows a cross-sectional view of an exemplary lobby dustpan in an open position and pressed down with an exemplary crowned sweep-ramp contacting the floor, or horizontal surface.

Figure 1:
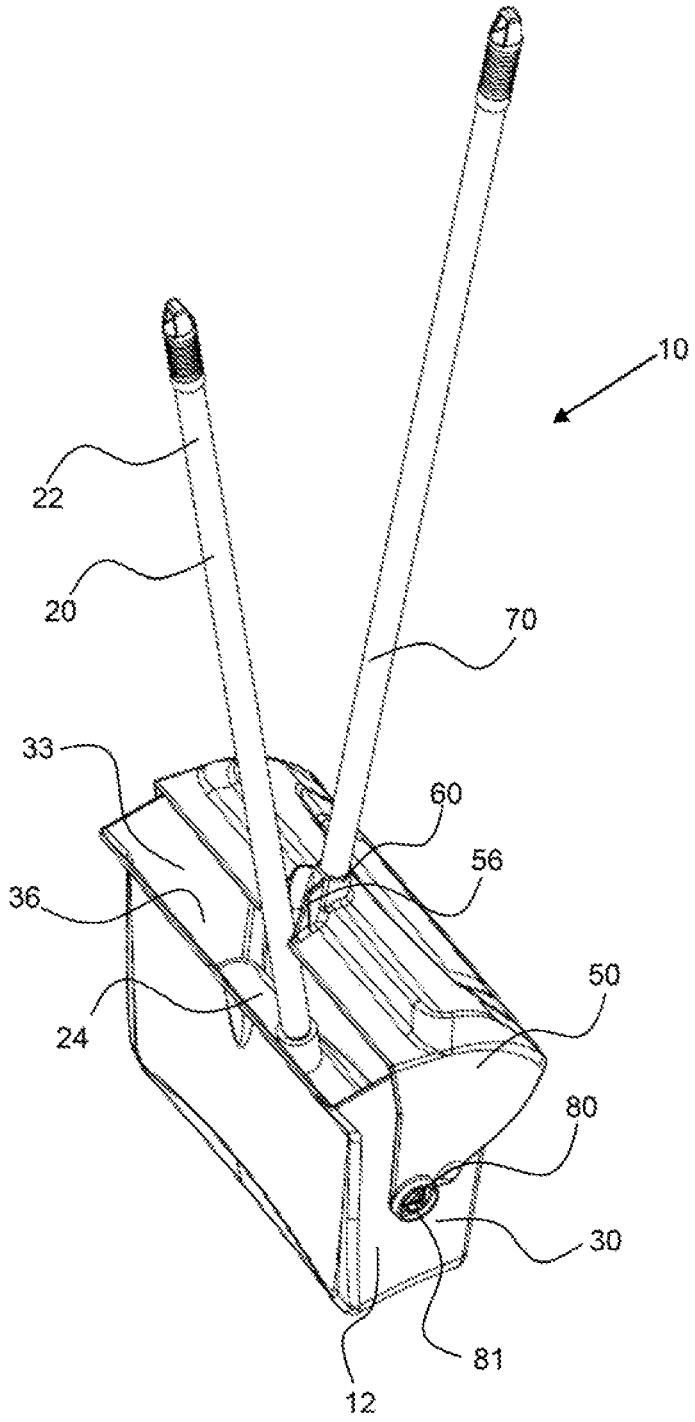
FIG. 1 shows a perspective view of an exemplary lobby dustpan with a broom head inserted into the interior volume of the bucket with the lid partially open exposing the opening of the bucket.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications and improvements are within the scope of the present invention.

As shown in FIG. 1, an exemplary lobby dustpan 10 has a broom head 24 of a broom 20 inserted into the opening 33 of the bucket 30. The broom head is retained in the interior volume 36 of the bucket and the broom handle 22 is aligned with the broom-handle coupling feature 56. The bucket 30 and lid 50 are coupled together by the pivoting assembly 80 as shown on the first side 12 of the lobby dustpan. The lobby dustpan handle 70 is coupled to the lid 50 by the lid-handle coupling feature 60. The lobby dustpan has a position locking feature 81 incorporated into the pivot assembly 80 that locks the bucket 30 portion of the lobby dustpan in an open position.

Figure 2:
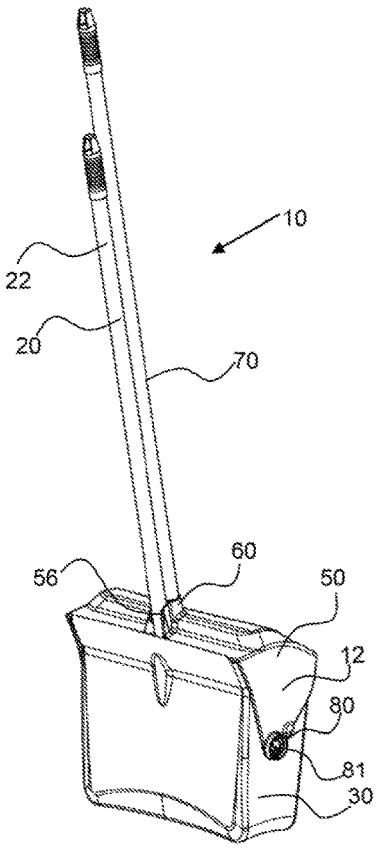
FIG. 2 shows a perspective view of an exemplary lobby dustpan with a broom head configured in the interior volume of the bucket and the handle of the broom snapped into the broom-handle coupling feature; the lobby dustpan is in a closed position.

As shown in FIG. 2, an exemplary lobby dustpan 10 is configured with a broom head inside of the bucket 30 and the broom-handle 22 is detachably attached to the broom-handle coupling feature 56. The broom head and debris thereon are all retained within the interior volume of the lobby dustpan and is substantially sealed to prevent contamination while in transport.

Figure 3:
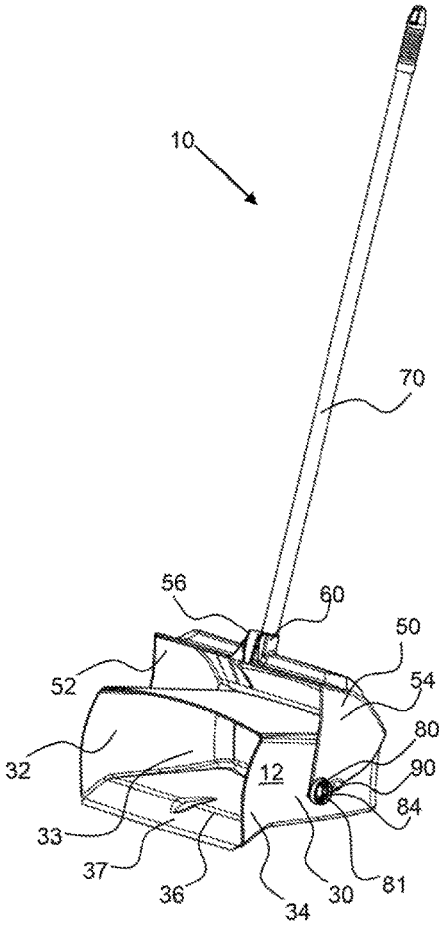
FIG. 3 shows a perspective view of an exemplary lobby dustpan in an open position with the bucket rotated away from the lid and the sweep ramp on the floor.

As shown in FIG. 3, an exemplary lobby dustpan 10 is in an open position with the bucket 30 rotated away from the lid 50 and the sweep-ramp 37 on the floor. The bucket is rotated open about the pivot assembly 80 and is in a locked position by the position locking feature 81. Debris can now be swept into the interior volume 36 of the bucket through the opening 33 in the bucket. The interior surface 32 of the bucket 30 may allow debris to flow down to the bottom of the bucket. The bucket hub 90 extends out from the exterior surface 34 of the bucket and engages with the lid to form the pivot assembly 80. The lid has an inside surface 52 and an outer surface 54.

Figure 4:
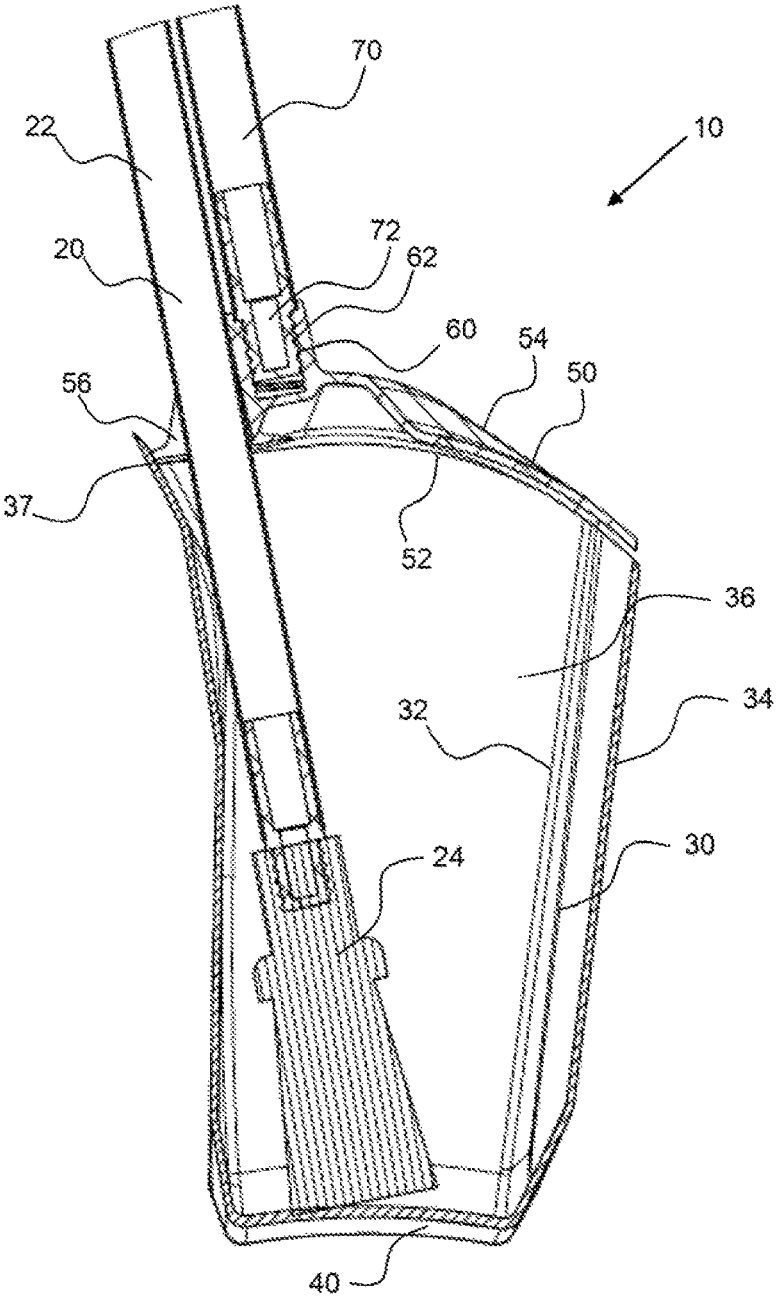
FIG. 4 shows a cross sectional view of an exemplary lobby dustpan with a broom head configured in the interior volume of the bucket and the handle of the broom snapped into the broom-handle coupling feature; the lobby dustpan is in a closed position.

As shown in FIG. 4, an exemplary lobby dustpan 10 has a broom head 24 configured in the interior volume 36 of the bucket 30 and the broom handle 22 is snapped, or detachably attached, to the broom-handle coupling feature 56. The broom handle 22 is aligned in parallel with the lobby dustpan handle 70. The lobby dustpan handle 70 has threads 72 that are coupled with the lid threads 62. The lobby dustpan is in a closed position wherein the interior volume is substantially sealed. The inside surface 52 of the lid 50 covers the bucket opening 33 to form the enclosure. The bucket has an interior surface 32 and an exterior surface 34.

Figure 5:
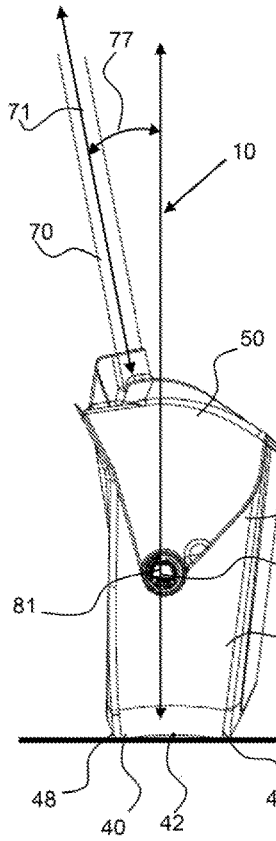
FIG. 5 shows a side view of an exemplary lobby dustpan in a closed position.
Figure 6:
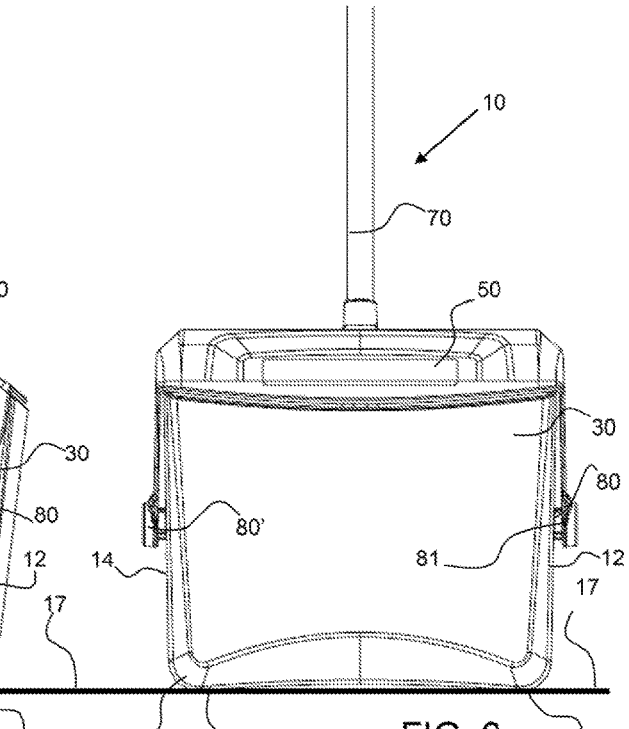
FIG. 6 shows a front view of an exemplary lobby dustpan in a closed position.
Figure 7:
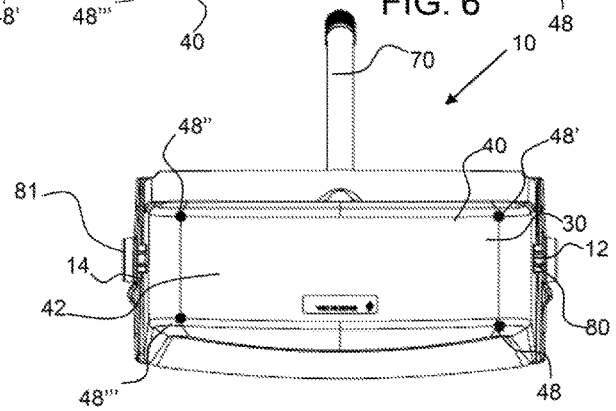
FIG. 7 shows a bottom view of an exemplary lobby dustpan in a closed position.
Figures 8, 9, 10:
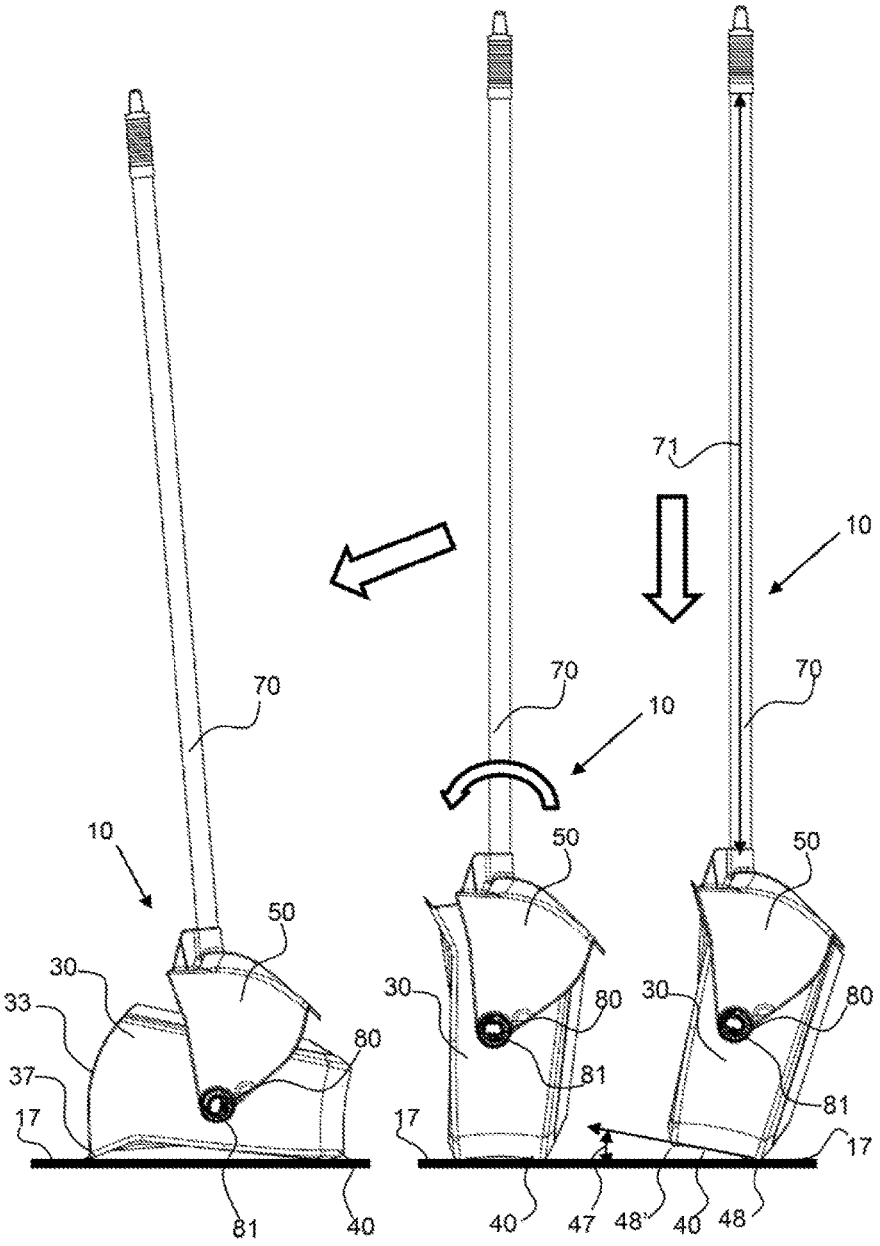
FIGS. 8 to 10 show side views of an exemplary lobby dustpan as it is opened by contacting the base with the floor and pushing down on the handle.

Referring now to FIGS. 5 to 7, an exemplary lobby dustpan 10 has a handle 70 detachably attached to the lid 50. The handle 70 has a length axis 71 that extends at an offset angle 77 to vertical when the lobby dustpan is resting on a flat horizontal surface 17 such as a floor. This offset angle allows the bucket to be rotated to an open position when the handle is brought straight down toward the floor, as shown in FIGS. 8 to 10. The lid rotates with respect to the bucket 30 about the pivot assembly 80. The base 40 of the bucket has a recess 42 whereby the base contacts the floor at four contact points 48-48'''. The contact points are proximal to the outer corners of the base and therefore provide stability. Pivot assembly 80, 80' are configured on the first side 12 an second side 14 respectively.

Referring now to FIGS. 8 to 10, an exemplary lobby dustpan 10 is configured to rotate from a closed position to an open position by manipulation of the handle 70. When the handle is in a vertical orientation, with the length axis of the handle extending vertically, and is brought straight down, as shown in FIG. 8, the back portion of the base contacts 48 contacts the floor first and this causes the bucket to rotate open, as shown in FIG. 9. The base, or a plane extending through the contact points of the base extends at a base offset angle 47 to a horizontal surface 17 when the handle is vertical. Further pressing of the handle down and forward will cause the bucket to open fully, as shown in FIG. 10. The unique geometry of the lobby dustpan makes opening and closing easy for the user.

Figures 11, 12, 13:
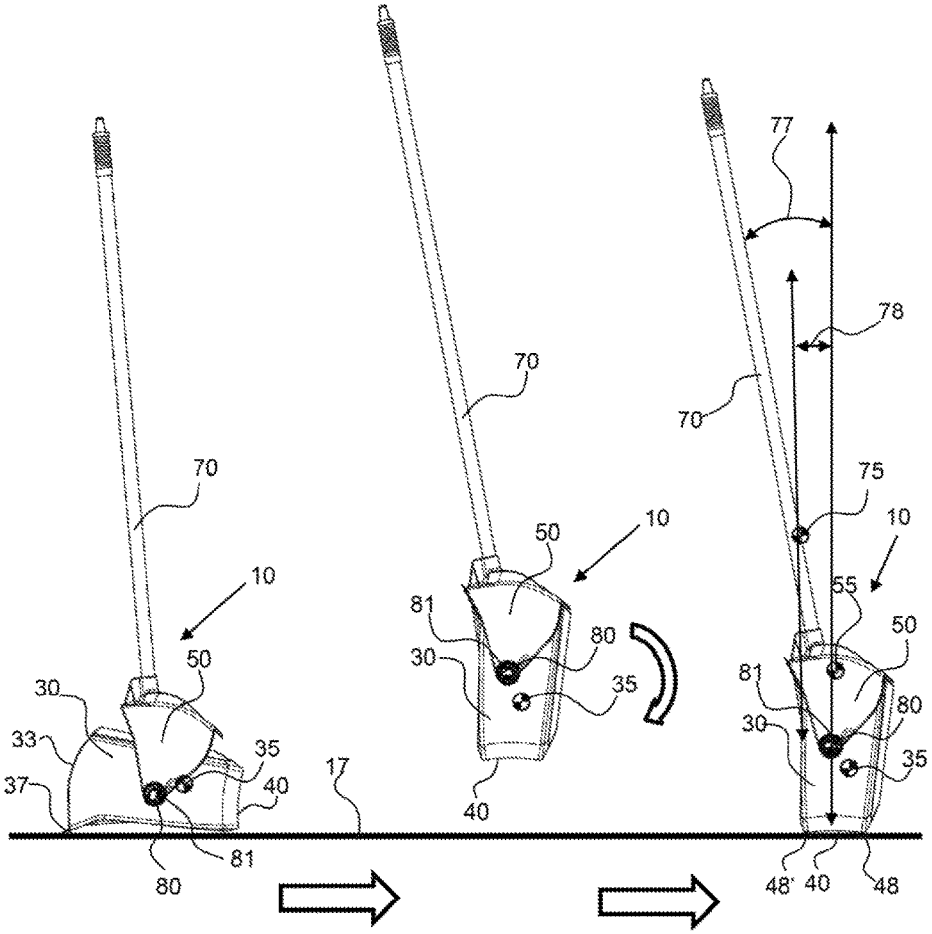
FIG. 11 to 13 show side views of an exemplary lobby dustpan as it automatically rotates back to a closed position when lifted by the handle from an open position.

Referring now to FIGS. 11 to 13, an exemplary lobby dustpan 10 will automatically rotate back to a closed position when lifted by the handle 70 from an open position. As shown in FIG. 11, the lobby dustpan is in an open position with the sweep-ramp 37 of the bucket 30 resting on the horizontal surface 17. The center of gravity 35 of the bucket is behind the pivot assembly 80, or between the pivot assembly and the base 40, when in an open position. As shown in FIG. 12, the center of gravity of the bucket 35 has pivoted about the pivot assembly 80 due to gravity. This location of the center of gravity automatically closes the bucket. As shown in FIG. 13, the lobby dustpan is now resting on the horizontal surface 17 and stands upright on the base 40. The center of gravity 75 of the handle 70 is forward the pivot assembly 80 by a handle offset distance 78 which keeps the lid closed when the lobby dustpan 10 is resting on a horizontal surface 17. The handle extends from the lid at a handle offset angle 77. Also, the lobby dustpan center of gravity 55 is between the contact points 48, 48' of the base 40 when the lobby dustpan is in an upright position on a horizontal surface 17, as shown in FIG. 13.

Figure 14:
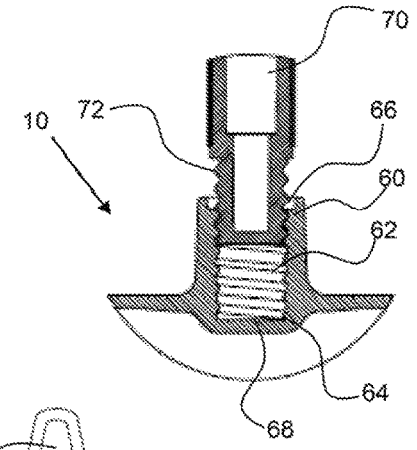
FIG. 14 shows a cross sectional view of an exemplary lobby dustpan handle partially inserted into the lid-handle coupling feature.

As shown in FIG. 14, an exemplary lobby dustpan handle 70 is partially inserted into the lid-handle coupling feature 60. The lid-handle coupling feature has female threads that are wider proximal to the insert end 66 to allow the handle threads 72 to engage easily. The lid threads 62 have a thread gap 64, and the thread gap proximal to the coupling base 68 is more narrow than the thread gap at the insert end, and this creates a tight fit with the handle threads. A portion of the lid threads proximal the base may be uniform over a rotational degree, such as about 360 degrees or more, to provide a firm retention of handle to the lid. This unique geometry provides a handle lid engagement wherein a small amount of rotation of the lid relative to the handle will not loosen the handle. In an exemplary embodiment, a full rotation or several rotations of threads from the coupling base have substantially the same gap width, thereby providing a tight region that prevents unwanted rotation of the handle with respect to the lid. The male threads on the handle may be tapered.

Figure 15:
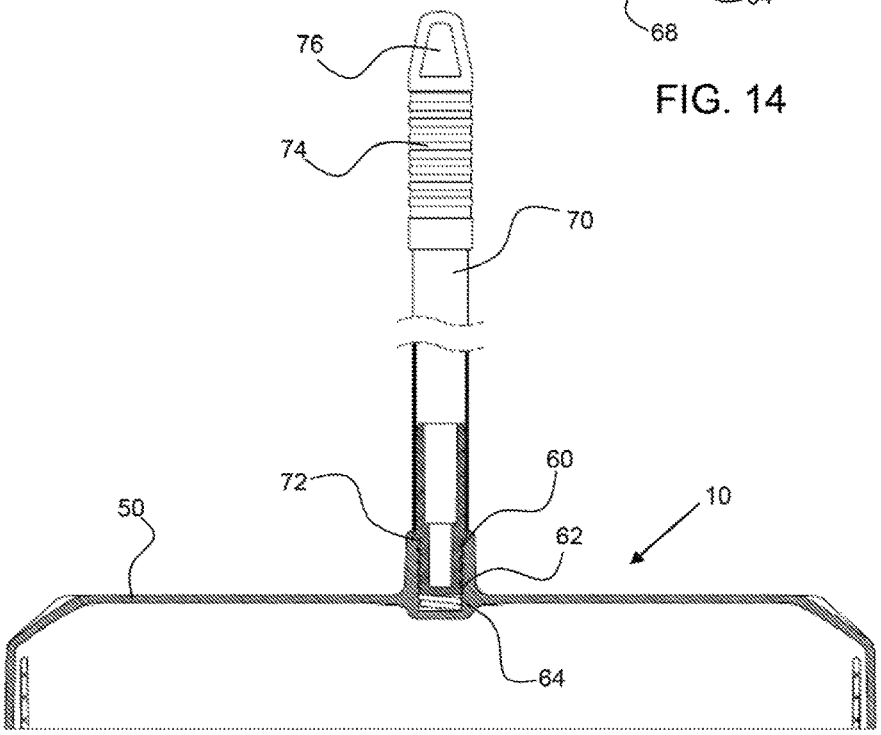
FIG. 15 shows a cross sectional view of an exemplary lobby dustpan handle inserted into the lid-handle coupling feature.

As shown in FIG. 15, an exemplary lobby dustpan handle 70 is inserted into the lid-handle coupling feature 60. The handle top 74 comprises a handle aperture 76 for hanging the lobby dustpan on a peg. The handle can be rotated 180 degrees while still maintaining firm retention of the handle with the lid. This is due to the unique thread geometry of the lid-handle coupling feature 60, as shown and described in FIG. 14.

Figure 16:
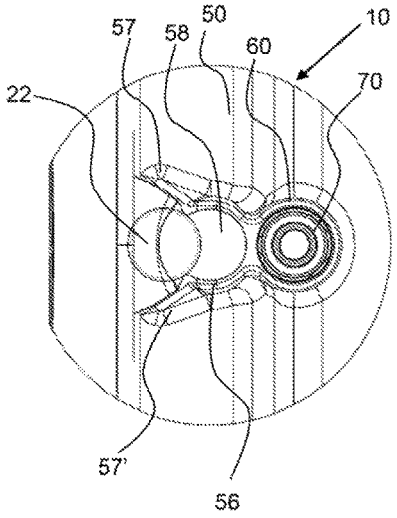
FIG. 16 shows a top view of an exemplary lid-handle coupling feature and broom-handle coupling feature with the broom handle detached from the broom-handle coupling feature.
Figure 17:
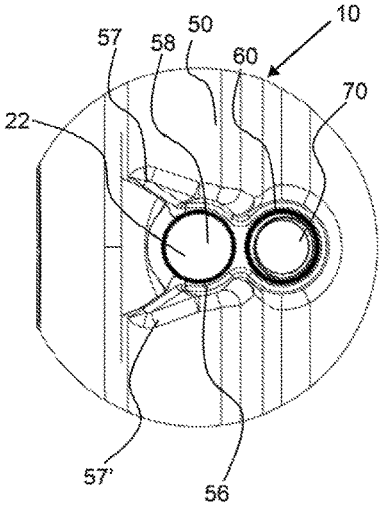
FIG. 17 shows a top view of an exemplary lid-handle coupling feature and broom-handle coupling feature with the broom handle attached to the broom-handle coupling feature.

Referring now to FIGS. 16 and 17, an exemplary broom-handle coupling feature enables a broom handle 70 to be detachably attached to the lid 50 of the lobby dustpan 10. The exemplary broom-handle coupling feature comprises a pair of extensions 57 that extend out from a receiving portion 58 or semicircular opening for receiving and retaining a broom handle. The extensions 57 extend toward the receiving portion to create a tapered entry into the receiving portion, thereby guiding the broom handle 70 into the receiving portion. The receiving portion may extend more than 180 degrees, such as about 200 degrees or more, about 240 degrees or more, less than about 300 degrees, and any range between and including the values provided. As shown in FIG. 17, the broom handle 22 is attached within the receiving portion 58 and extends in parallel with the lobby dustpan handle 70.

Figure 18:
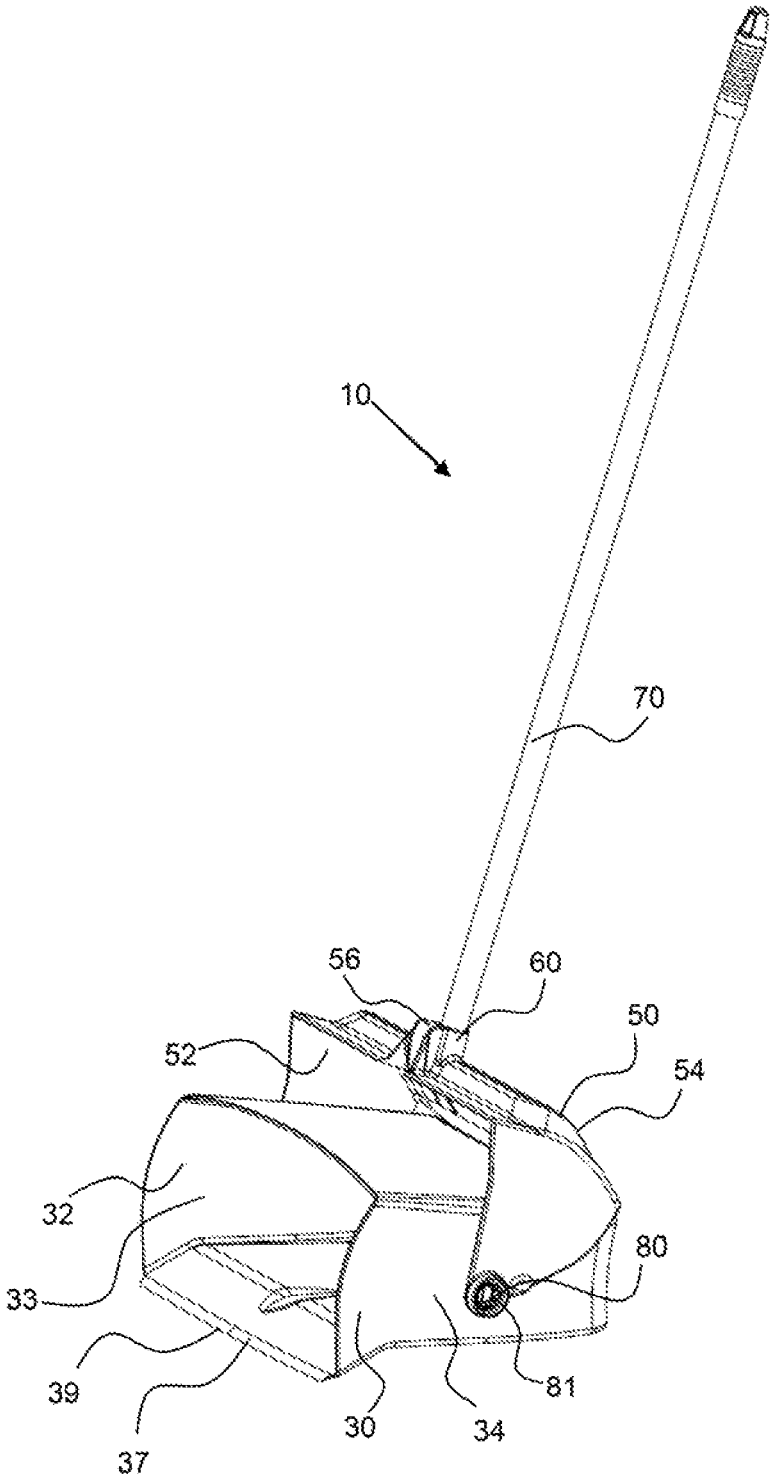
FIG. 18 shows a perspective view of an exemplary lobby dustpan in an open and locked position.

As shown in FIG. 18, an exemplary lobby dustpan 10 is an open and locked open position. The sweep-ramp 37 is resting on the horizontal surface 17 and has a ramp crown 39 to ensure full contact across the length of the sweep-ramp. The center of the sweep-ramp extends out more than either end, thereby forming a crown.

Referring now to FIGS. 19 to 23, an exemplary pivoting assembly 80 comprises a bucket hub 90 that extends out from the exterior surface 34 of the bucket 30, and a lid aperture 82 for receiving the bucket hub. The lid aperture extends through the lid 50 from the inside surface 52 to the outside surface 54. An attachment tab 98 extends from the bucket 30 and into the lid aperture 82 and the locking head 99 of the attachment tab catches on the outside surface 54 of the lid to secure the lid 50 to the bucket 30, as best shown in FIG. 19. The attachment tab deflects for entry into the lid aperture and deflects back out to secure the locking head to the lid. The attachment tab can be pressed inward to release the locking head from the lid and the lid and bucket can be detached from each other, as shown in FIG. 21. An access feature 97, such as a recess along the edge of the lid, allows a user to more easily separate the lid from the bucket.

Figure 22:
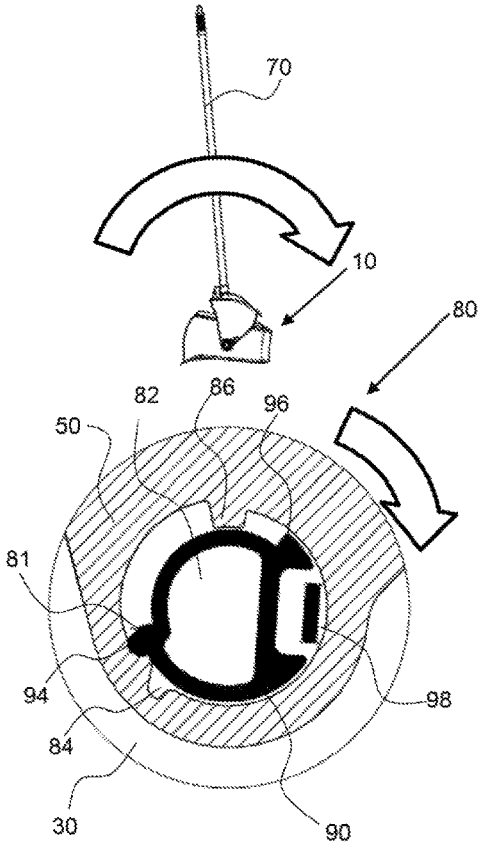
FIG. 22 shows a cross sectional view of an exemplary pivoting assembly having a position locking feature.
Figure 23:
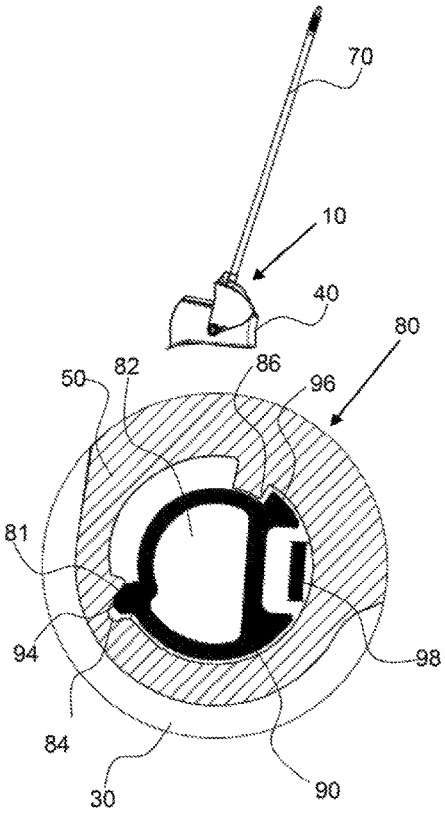
FIG. 23 shows a cross sectional view of an exemplary pivoting assembly having a position locking feature in a locked position.

The pivot assembly 80 comprises a position locking feature 81 comprising a detent 84 and a detent-coupler 94 as shown in FIGS. 22 and 23. The detent-coupler extends into the detent when the lid 50 is rotated with respect to the bucket 30. As shown in FIG. 22, the detent-coupler 94 is not aligned with the detent. This corresponds with the orientation of the lobby dustpan 10 as shown above the pivot assembly, wherein the handle 70 is still forward a locked position. As shown in FIG. 23, the handle 70 is pulled back, toward the base 40 of the bucket and this aligns the detent-coupler 94 with the detent 84. A stop 86 is configured on the lid aperture 82 and engages with the stop extension 96 to prevent over rotation of the handle. The stop extension 96 hits the stop 86 when the detent-coupler 94 is aligned with the detent. It will take some force to move the handle forward and overcome the engagement of the detent-coupler with the detent.

Figure 24:
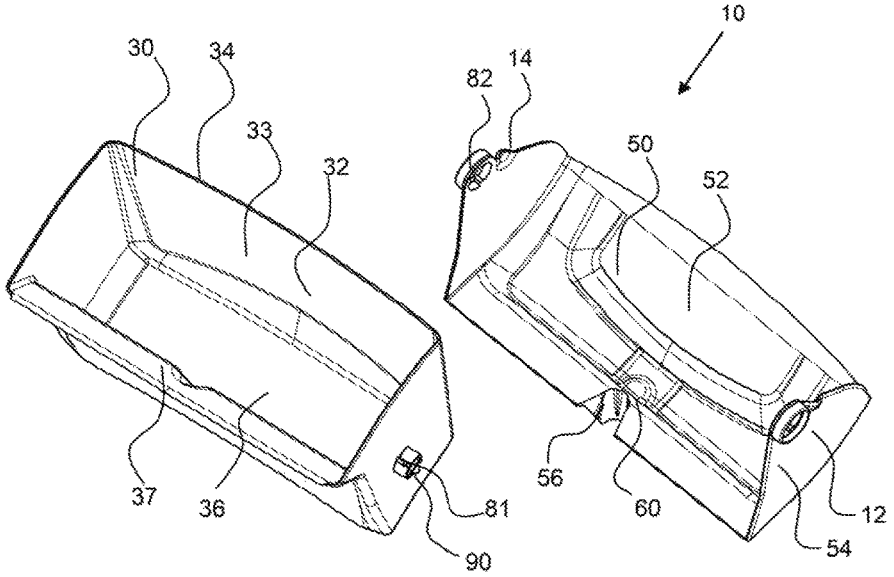
FIG. 24 shows a perspective view of the lid detached from the bucket portion of the lobby dustpan.

As shown in FIG. 24 the lid 50 is detached from the bucket 30.

Referring now to FIGS. 25 to 29, an exemplary lobby dustpan 10 comprises a crowned sweep-ramp 37 having a ramp extended end 38 and sweep-ramp ends 43, 43' that are position back from the center of the sweep-ramp. The crowned sweep ramp ensures uniform contact with the floor as the sweep ramp can be deformed by pressing down. The center portion of the sweep ramp may initially contact the floor, as shown in FIG. 26 and there may be a ramp gap 44, as shown in FIG. 26, near the edges 43'. However, when the bucket is pressed down by the handle the outer portions of the sweep ramp 43, 43' may make contact with the floor, or horizontal surface 17, as shown in FIGS. 28 and 29.

It will be apparent to those skilled in the art that various modifications. combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A lobby dustpan comprising:

a) a handle; and b) a lid;

wherein the handle is attached to the lid;

c) a bucket comprising:

i) an opening and interior volume for receiving debris;

ii) a sweep ramp; and iii) a base;

d) a pivot assembly configured on a first and a second side of the lobby dustpan that couples the bucket to the lid, wherein each pivot assembly comprises:

i) a bucket hub;

ii) a lid aperture for receiving the bucket hub; and iii) a position locking feature comprising:

a detent for receiving a detent-coupler;

wherein the detent-coupler extends into the detent when the lid is rotated with respect to the bucket to a locked position.

2. The lobby dustpan of claim 1, wherein the pivot assembly further comprises a stop that extends from the lid aperture to interface with a stop-extension on the bucket hub to prevent rotation of the lid with respect to the bucket.

3. The lobby dustpan of claim 2, wherein the stop is configured to interface with the stop-extension when the lid is rotated with respect to the bucket to a locked position.

4. The lobby dustpan of claim 1, wherein the detent is configured in the lid and the detent-coupler is configured in the bucket hub.

5. The lobby dustpan of claim 1, wherein at least one of the pivot assemblies comprises an attachment tab that extends from the bucket and into the lid aperture, and wherein the lid and bucket are detachably attachable.

6. The lobby dustpan of claim 5, wherein the attachment tab comprises a locking head that engages with the lid to lock the lid to the bucket when the lid and bucket are attached.

7. The lobby dustpan of claim 1, wherein the bucket has a center of gravity between the bucket hub and the base of the bucket when in an open position, whereby the bucket will close automatically when the handle is lifted up vertically to lift the lobby dustpan from an open position with the sweep-ramp resting on the floor.

8. The lobby dustpan of claim 1, wherein the handle has a handle center of gravity that is forward the pivot assembly by a handle offset distance and a length axis that extends forward toward the sweep ramp at a handle offset angle of at least ID degrees to vertical when the lobby dustpan is standing upright on a horizontal surface, wherein the handle center of gravity offset distance and handle offset angle keen the lid closed when the lobby dustpan is resting on the base in an upright and closed position.

9. The lobby dustpan of claim 8, wherein base has recesses producing four base contacts that contact the horizontal surface when the lobby dustpan is standing upright on said horizontal surface.

10. The lobby dustpan of claim 1, further comprising a broom-handle coupling comprising a pair of extensions that extend from a receiving portion for retaining a broom handle to the lid and a broom head within the bucket.

11. The lobby dustpan of claim 10, wherein the receiving portion extends at least 200 degrees about a radius for retaining the broom handle.

12. The lobby dustpan of claim 10, wherein the extensions taper toward the receiving portion to guide the broom handle into the receiving portion.

13. A lobby dustpan comprising:

a) a handle; and b) a lid;

wherein the handle is attached to the lid;

c) a bucket comprising;

i) an opening and interior volume for receiving debris; is) a sweep ramp; and ii) a base;

d) a pivot assembly configured on a first and a second side of the lobby dustpan that couples the bucket to the lid, wherein each pivot assembly comprises:

i) a bucket hub:

ii) a lid aperture for receiving the bucket hub; and Hi) a position locking feature comprising:

a detent for receiving a detent-coupler; wherein the detent-coupler extends into the detent when the lid is rotated with respect to the bucket to a locked position;

iv) a stop that extends from the lid aperture to interface with a stop extension on the bucket hub to prevent rotation of the lid with respect to the bucket;

wherein the stop is configured to interface with the stop-extension when the lid is rotated with respect to the bucket to a locked position;

wherein at least one of the divot assemblies comprises an attachment tab that extends from the bucket and into the lid aperture when the lid and bucket are attached; and wherein the lid and bucket are detachably attachable;

and wherein the bucket has a center of gravity between the bucket hub and the base of the bucket when in an open position, whereby the bucket will close automatically when the handle is lifted up vertically to lift the lobby dustpan from an open position with the sweep-ramp resting on the floor.

14. The lobby dustpan of claim 13, wherein the detent is configured in the lid and the detent-coupler is configured in the bucket hub.

15. The lobby dustpan of claim 13, wherein the attachment tab comprises a locking head that engages with the lid to lock the lid to the bucket when the lid and bucket are attached.

16. The lobby dustpan of claim 13, wherein the handle has a length axis that extends forward toward the sweep ramp at an offset angle of at least 10 degrees to vertical when the lobby dustpan is standing upright on a horizontal surface.

17. The lobby dustpan of claim 13, wherein base has recesses producing four base contacts that contact a horizontal surface when the lobby dustpan is standing upright on said horizontal surface.

18. The lobby dustpan of claim 13, further comprising a broom handle coupling comprising a pair of extensions that extend from a receiving portion for retaining a broom handle to the lid and a broom head within the bucket.

19. The lobby dustpan of claim 18, wherein the receiving portion extends at least 200 degrees about a radius for retaining the broom handle; and wherein the extensions taper toward the receiving portion to guide the broom handle into the receiving portion.

20. A lobby dustpan comprising;

a) a handle; and b) a lid;

wherein the handle Is attached to the lid;

c) a bucket comprising;

i) an opening and interior volume for receiving debris; is) a sweep ramp; and ill} a base;

d) a pivot assembly configured on a first and a second side of the lobby dustpan that couples the bucket to the lid, wherein each pivot assembly comprises;

i) a bucket hub;

ii) a lid aperture for receiving the bucket hub; and ill) a position locking feature comprising:

a detent for receiving a detent-coupler;

wherein the detent-coupler extends into the detent when the lid is rotated with respect to the bucket to a locked position; and e) a broom-handle coupling comprising a pair of extensions that extend from a receiving portion for retaining a broom handle to the lid and a broom head within the bucket.

* * * * *